US006016794A

United States Patent [19]

Hashimoto et al.

[11] Patent Number: 6,016,794

[45] Date of Patent: Jan. 25, 2000

[54] FUEL INJECTION CONTROL APPARATUS FOR INTERNAL COMBUSTION ENGINE

[75] Inventors: Atsuko Hashimoto; Shiro Yonezawa; Hirofumi Ohuchi, all of Tokyo; Tatsuhiko Takahashi, Hyogo, all of Japan

[73] Assignee: Mitsubishi Denki Kabushiki Kaisha, Tokyo, Japan

[21] Appl. No.: 09/014,153

[22] Filed: Jan. 27, 1998

[30] Foreign Application Priority Data

Oct. 20, 1997 [JP] Japan ..... 9-287005

[51] Int. Cl.[7] ..... F02D 41/30

[52] U.S. Cl. ..... 123/675; 123/682; 123/683; 123/492

[58] Field of Search ..... 123/675, 683, 123/492, 399, 682

[56] References Cited

U.S. PATENT DOCUMENTS

| | | | |
|---|---|---|---|
| 4,886,030 | 12/1989 | Oba et al. | 123/492 |
| 4,951,209 | 8/1990 | Nagaishi et al. | 123/492 |
| 4,971,011 | 11/1990 | Nanyoshi et al. | 123/492 |
| 4,987,888 | 1/1991 | Funabashi et al. | 123/492 |
| 5,025,380 | 6/1991 | Wataya et al. | 123/492 |
| 5,195,491 | 3/1993 | Kuroda . | |

FOREIGN PATENT DOCUMENTS 4-339144 11/1992 Japan .

*Primary Examiner*—Erick R. Solis
*Attorney, Agent, or Firm*—Sughrue, Mion, Zinn, Macpeak & Seas, PLLC

[57] ABSTRACT

A fuel injection control apparatus for an internal combustion engine includes an injector control apparatus 120B for controlling a fuel injection amount toward a target fuel injection amount Fm. The injector control apparatus 120B includes an expected engine revolution number calculating means 9 for calculating an expected engine revolution number Nf for a predetermined interval based on the engine revolution number Ne, expected throttle opening degree calculating means 10 for calculating an expected throttle opening degree θf for the predetermined interval based on a throttle opening degree θ, expected drawn air amount calculating means 11 for calculating an expected drawn air amount Qf for the predetermined interval based on the expected engine revolution number and the expected throttle opening degree, and target fuel injection amount calculating means 12 for calculating a target fuel injection amount Fm. With the above arrangement, a deviation in air-fuel ratio is suppressed and an exhaust gas is improved.

10 Claims, 14 Drawing Sheets

FUEL INJECTION CONTROL APPARATUS FOR INTERNAL COMBUSTION ENGINE

BACKGROUND OF THE INVENTION

1. Field of the Invention

The present invention relates to a fuel injection control apparatus for an internal combustion engine, and more particularly, to a fuel injection control apparatus for an internal combustion engine in which an exhaust gas is improved by injecting a fuel in accordance with an actual drawn air amount.

2. Description of the Related Art

FIG. 7 shows a structure of a conventional fuel injection control apparatus for an internal combustion engine, in which an operation of a throttle is controlled in mechanically association with an accelerator.

In FIG. 7, an engine 1 which is the body of the internal combustion engine comprises, e.g., six cylinders. An air cleaner 102 is mounted to an intake port of an intake passage 103 for purifying a drawn air to be supplied to the engine 101.

An accelerator pedal 104 which is operated by a driver is mechanically connected to a throttle valve 106 in the intake passage 103 through a wire wound around an accelerator link 105. With this arrangement, the throttle valve 106 is associatively operated in accordance with an operation of the accelerator pedal 104, thereby adjusting the air amount to be drawn to the engine 101.

A throttle opening sensor 107 detects a position of the throttle valve 106, i.e., a throttle opening degree θ.

An intake manifold 108 is mounted to a drawing side of the engine 101 for equalizing an amount of air to be drawn to each of the cylinders.

A drawn air amount sensor 109 detects a drawn air amount Q passing through the intake passage 103.

A crank angle sensor 110 is mounted to a crankshaft of the engine 101, and produces a crank angle signal SGT which corresponds to a crank angle reference position of each of the cylinders (#1 to #6). A cylinder identifying sensor 111 is provided to a camshaft of the engine 101, and produces a cylinder identification signal SGC which corresponds to a specific cylinder (e.g., #1 cylinder).

An injector 112 for injecting a fuel is mounted to each of the cylinders of the engine 101.

An igniter 113, an ignition coil 114, a distributor 115 and sparkplugs 116 constitute an igniting apparatus of the engine 101.

The igniter 113 comprises a power transistor for exciting the ignition coil 114. The ignition coil 114 comprises a transformer, and outputs a high voltage signal from a secondary coil by shutting off electricity of a primary coil. The distributor 115 distributes the high voltage signal from the ignition coil 114 to each of the spark plugs 116.

Each of the sparkplugs 116 is provided in a combustion chamber of each of the cylinders. The sparkplug 116 generates an electrical discharge spark by the high voltage signal applied through the distributor 115, thereby burning a mixed gas in each of the cylinders for driving the engine 101.

An exhaust passage 117 discharges, an exhaust gas produced after the mixed air is burnt in the engine 101, into the atmosphere. A catalyst converter 118 is mounted to an exhaust port of the exhaust passage 117 for purifying the exhaust gas.

The throttle opening degree sensor 107, the drawn air amount sensor 109, the crank angle sensor 101 and the cylinder identifying sensor 111 constitute various sensors for detecting the driving state of the engine 101.

Further, as the occasion demands, other various sensors are also provided, such as a revolution number sensor (which will be described later) for detecting the number of revolutions of the engine based on the crank angle signal SGT, a water temperature sensor for detecting a cooling water temperature of the engine 101, and an accelerator pedal opening degree sensor (not shown) for detecting a depressed amount of the accelerator pedal as an opening degree of the accelerator pedal.

A control unit 120 comprising a microcomputer includes a fuel injection (injector) control apparatus and an ignition control apparatus, and calculates an appropriate fuel injection amount and igniting timing of the engine 101 based on detected information (driving state) from the various sensors and outputs a control signal in accordance with control amounts of various parameters.

The injector control apparatus in the control unit 120 calculates an appropriate fuel injection amount based on the drawn air amount Q from the drawn air amount sensor 109 and the crank angle signal SGT (engine revolution number) from the crank angle sensor 110. Then, the injector control apparatus determines which cylinder should be subject to fuel injection, based on the cylinder identification signal SGC from the cylinder identifying sensor 111, and outputs an injection signal J to the injector 112 of the corresponding cylinder to inject a fuel.

Further, the ignition control apparatus in the control unit 120 outputs an ignition signal P to the igniter 113 for exciting the ignition coil 114, and ignites the sparkplug 116 through the distributor 115 for driving the engine 101.

FIG. 8 is a block diagram for showing a functional structure of the control unit 120, and shows a basic structure of the injector control apparatus.

In FIG. 8, drawn air amount detecting means 1 functions as an input I/F concerning the drawn air mount from the drawn air amount sensor 109, and calculates an actual drawn air amount from a signal indicative of the drawn air amount Q.

The crank angle detecting means 2 functions as an input I/F concerning the crank angle signal SGT from the crank angle sensor 110, and detects a crank angle reference position for every cylinder based on the crank angle signal SGT.

An engine revolution number detecting means 3 functions as an input I/F concerning the revolution number sensor, and calculates the engine revolution number Ne based on the crank angle signal SGT (a cycle of the crank angle reference position).

A basic fuel injection amount calculating means 4 calculates a basic fuel injection amount Fo which is necessary for combustion, based on the drawn air amount Q detected by the drawn air amount detecting means 1 and the engine revolution number Ne calculated by the engine revolution number detecting means 3.

A fuel injection amount correcting means 5 detects states of the engine 101 such as an accelerating/decelerating driving state thereof based on sensed information indicative of driving states of the engine 101 including the drawn air amount Q (such as cooling water temperature and load of the engine), and calculates a corrected fuel injection amount Fa which is obtained by correcting the basic fuel injection amount Fo.

When an accelerating driving state is detected based on a variation amount Δ of the drawn air amount Q for example, the fuel injection amount correcting means 5 corrects to increase the basic fuel injection amount Fo to provide a corrected fuel injection amount Fa, so as to compensate a shortage of a fuel for acceleration. Therefore, an excellent fuel injection control is realized even during a transitional driving state such as accelerating or decelerating driving state.

The throttle opening degree detecting means 6 calculates a value of an actual throttle opening degree based on a signal indicative of a throttle opening degree θ from the throttle opening degree sensor 107.

A non-synchronous fuel injection amount calculating means 7 determines that the driving state is a rapid accelerating driving state based on a variation amount Δθ of the throttle opening degree θ detected by the throttle opening degree detecting means 6, and calculates a non-synchronous fuel injection amount Fb for injecting fuel non-synchronously.

A fuel injection control means 8 produces an injection signal J which corresponding to a final fuel injection amount in accordance with the corrected fuel injection amount Fa and the non-synchronous fuel injection amount Fb.

Next, referring to timing charts in FIGS. 9 to 14, an operation of the conventional fuel injection control apparatus for the internal combusiton engine shown in FIGS. 7 and 8.

FIG. 9 shows an operation of the injector 112 of each of the cylinders at the time of normal driving, and shows a relationship between processes (comprising four cycles, i.e., compression, combustion, evacuation and air-drawing) of each of the cylinders (#1 to #6) of the engine 101, and operational timings of the injection signals J1 to J6 with respect to the cylinders (#1 to #6).

In FIG. 9, the cylinder identification signal SGC includes a pulse corresponding to the #1 cylinder only, so as to identify the #1 cylinder.

The crank angle signal SGT comprises a plurality of pulses having edges corresponding to crank angle reference positions of the respective cylinders.

In this case, FIG. 9 shows that a crank angle position in a region from a falling-down edge to a rising edge of the crank angle signal SGT when the cylinder identification signal SGC is H (high) level corresponds to an igniting timing of #1 cylinder.

Each of processes of #1 cylinder to #6 cylinder are synchronized with each of the edges of the crank angle signal SGT.

FIGS. 10 to 11 show an operation of the fuel injection amount correcting means 5, and show a correcting operation to increase a fuel injection amount at the time of acceleration.

In this case, the throttle valve 106 is associatively operated with the depressing operation of the accelerator pedal 104 substantially in a synchronized manner. However, because the actual drawn air amount Q is behind the operation of the throttle valve 106, the actual drawn air amount Q is varied after the accelerator pedal opening degree α is varied.

When the fuel injection amount correcting means 5 determines that the driving state is an accelerating driving state based on a variation of the drawn air amount Q, a driving time of, e.g., an injection signal J6 with respect to #6 cylinder is elongated to correct a fuel injection amount such as to increase the same, thereby substantially making it possible to supply a fuel in an amount necessary for combustion.

FIGS. 12 to 14 show an operation of the non-synchronous fuel injection amount calculating means 7, and show an injection timing of the non-synchronous fuel injection amount Fb at the time of rapid acceleration.

In FIGS. 12 to 14, when the non-synchronous fuel injection amount calculating means 7 determines that the driving state is a rapid accelerating driving state, the non-synchronous fuel injection amount calculating means 7 produces, apart from driving times t4 to t6 of normal injection signals J4 to J6, injection signals (see the shaded portions) each having a constant pulse width t with respect to, e.g., #4 and #6 cylinders.

Further, in FIG. 13, when the non-synchronous fuel injection amount calculating means 7 determines that the driving state is a rapid accelerating driving state, the non-synchronous fuel injection amount calculating means 7 produces injection signals (see the shaded portions) each having a pulse width t with respect to, e.g., #4 to #6 cylinders.

With this arrangement, it is possible to supply, as a non-synchronous fuel injection amount Fb, a fuel in an amount corresponding to a predetermined pulse width t.

First, at a falling-down time point tn of the crank angle signal SGT, the drawn air amount detecting means 1 detects a drawn air amount Q(n) during falling-down of the crank angle signal SGT, and the engine revolution number detecting means 3 detects the engine revolution number N(n) from a measured cycle T(n) during falling-down of the crank angle signal SGT.

The basic drawn air amount calculating means 4 calculates the basic fuel injection amount Fo based on the drawn air amount Q(n) and the engine revolution number N(n). The fuel injection control means 8 outputs a fuel injection amount as corrected in accordance with a driving state, in a form of injection signals J1 to J6 with respect to the respective injectors 112 as shown in FIG. 9.

The injection signals J1 to J6 are produced such as to start injecting a fuel synchronously with the falling-down of the crank angle signal SCT during an evacuating process of each of the cylinders.

At that time, the fuel injection amount is calculated based on the drawn air amount and the engine revolution number at the time point prior to the air-drawing process of a cylinder to which a fuel is to be injected. However, at the time of normal driving, because there is no large variation in the drawing air amount Q and the engine revolution number Ne, any problem is not caused.

However, at the time of transition driving such as an accelerating or decelerating driving, the drawn air amount Q and the engine revolution number Ne are varied before and during the air-drawing process of a cylinder to which a fuel is to be injected.

More specifically, a fuel injection amount calculated based on the drawn air amount Q and the engine revolution number Ne before the air-drawing process is too small at the time of acceleration, and is too large at the time of deceleration.

Therefore, the fuel injection amount correcting means 5 determines that the driving state is a transition driving state from a variation amount ΔQ of the drawn air amount Q at the falling-down time point of the crank angle signal SGT, and corrects the fuel injection amount at the time of transition driving. For example, the injection signal J is controlled such that if an accelerating driving state is identified, a correction is made to increase the fuel injection amount to compensate the shortage of fuel, and if a decelerating driving is identified, a correction is made to decrease the fuel injection amount to avoid the excessive fuel.

In FIG. 10 for example, the accelerator pedal opening degree $\alpha$ is increased from a position just before the air-drawing process of #4 cylinder is started. In response to this accelerating driving, the drawn air amount Q is increased from a position corresponding to about one third from the start of the air-drawing process of #4 cylinder.

Meanwhile, in FIG. 11, a depressing timing of the accelerator pedal 104 is a little late as compared with a case shown in FIG. 10, and the accelerator pedal opening degree $\alpha$ is increased from a position just after the air-drawing process of #4 cylinder is started, and the drawn air amount Q is increased at a position corresponding to about two third from the start of the air-drawing process of #4 cylinder.

In FIGS. 10 and 11, with a falling-down of the crank angle signal SGT which is the fuel injection starting timing with respect to, e.g., #6 cylinder, an acceleration is identified in view of variation in the drawn air amount. Therefore, the injection signal J6 with respect to #6 cylinder is elongated to make a correction to increase the fuel injection amount.

However, because this correction amount is determined by matching under a predetermined condition, an air-fuel ratio varies widely depending upon a depressing timing or a depressing amount of the accelerator pedal, and there is a fear that an exhaust gas is deteriorated. Further, with a falling-down of SGT which is the fuel injection starting timing with respect to #5 cylinder, there is no variation in the drawn air amount Q, and such a timing is the one before the accelerating driving state is identified. Therefore, the fuel is not corrected.

In FIGS. 10 and 11, the fuel injection amount of #5 cylinder is substantially constant, and a fuel is injected in the latter half of the evacuation process. Therefore, the air-fuel ratio of #5 cylinder is determined by an actual air charging amount of #5 cylinder.

However, between the cases shown in FIGS. 10 and 11, depression timings of the accelerator pedal are different and variation timings of the drawn air amount Q are also different. Therefore, air charging amounts of #5 cylinder are different and thus, air-fuel ratios are also different.

As described above, in the conventional apparatus, the throttle opening degree $\theta$ relies upon the operation of the accelerator pedal, and the air charging amount of the engine 101 is varied for every operation of the accelerator pedal. Therefore, the air-fuel ratio and the exhaust gas vary widely, which brings out a deterioration of the exhaust gas.

Further, at the time of rapid acceleration, even if a correction is made to increase the fuel injection amount for a normal acceleration, a fuel in an amount necessary for combustion (a fuel in an amount which meets an actual charging air amount in a cylinder) is not supplied in time, which brings out an excess or a shortage of fuel. In order to prevent this, a non-synchronous fuel injection is conducted as temporary measures.

More specifically, if the non-synchronous fuel injection amount calculating means 7 determines that the driving state is a rapid accelerating driving state in view of the throttle opening degree $\theta$ or the like, the non-synchronous fuel injection amount calculating means 7 produces an injection signal (see the shaded portions in FIG. 12) corresponding to the non-synchronous fuel injection amount Fb, irrespective of a fuel injecting timing for every cylinder.

The non-synchronous fuel injection amount calculating means 7 conducts a fuel injection non-synchronously with a falling-down timing of the crank angle signal SGT with respect to a cylinder whose drawn air amount Q is expected or predicted to be increased, thereby compensating an excess or shortage of fuel.

For example, when a variation amount $\Delta\theta$ of the throttle opening degree $\theta$ during a predetermined time period is equal to or greater than a predetermined value, a determination is made that the driving state is a rapid accelerating driving state, and a non-synchronous fuel injection is conducted with respect to a cylinder which is in an evacuating process or air-drawing process when the rapid acceleration is detected.

Therefore, there can be various cases for such a non-synchronous fuel injection depending upon a timing when the rapid acceleration is detected.

For example, FIG. 12 shows a case in which a rapid acceleration is detected at a substantially intermediate position of a interval T1, and a non-synchronous fuel injection is conducted.

If a fuel injection amount by a normal fuel injection (synchronous injection) and a fuel injection amount by non-synchronous injection when a rapid accelerating is detected are added, fuels in amounts corresponding to injector driving times t4+t, t5+t and t6+t by injection signals J4 to J6 are charged to #4 to #6 cylinders, respectively.

FIG. 13 shows a case in which a rapid acceleration is detected at the first half position of the interval T1, and a non-synchronous fuel injection is conducted.

In this case, at a time point when the non-synchronous injection is to be started, because a normal fuel injection (synchronous injection) is conducted for #5 cylinder, a non-synchronous injection is not conducted. Therefore, fuels in amounts corresponding to injector driving times t4+t, t5+t and t6+t by injection signals J4 to J6 are charged to #4 to #6 cylinders, respectively, and a fuel injection amount for #5 cylinder is reduced as compared with the case shown in FIG. 12.

FIG. 14 shows a case in which a rapid acceleration is detected at the latter half position of the interval T1, and a non-synchronous fuel injection is conducted.

In this case, as in the case shown in FIG. 12 in which the rapid acceleration is detected at an intermediate position of the interval T1, non-synchronous injections are conducted with respect to #4 to #6 cylinders and therefore, fuels in amounts corresponding to injector driving times t4+t, t5+t and t6+t by injection signals J4 to J6 are charged to #4 to #6 cylinders.

However, the non-synchronous fuel injecting timing shown in FIG. 14 corresponds to an end of the air-drawing process of #4 cylinder. Together with this fact, a supply of fuel is also retarded and thus, all of non-synchronously injected fuel can not be charged into #4 cylinder during this cycle. Therefore, remaining fuel which was not charged into #4 cylinder is to be charged at a next air-drawing process of #4 cylinder.

As described above, a timing for detecting a rapid acceleration is varied depending upon a charging amount of fuel for a cylinder, even in one fuel injection interval. Therefore, there is a possibility that an amount of fuel increases excessively and the air-fuel ratio is inclined toward a rich side, or an amount of fuel decreased excessively and the air-fuel ratio is inclined toward a lean side.

Further, because a non-synchronous injection control at the time of a rapid acceleration is conducted when a variation amount $\Delta\theta$ of a throttle opening degree during the predetermined time period is equal to or greater than the predetermined value, the air-fuel ratio is varied also depending upon a speed or an amount (accelerator pedal opening degree $\alpha$) of depression of the accelerator pedal 104.

Furthermore, even if the accelerator pedal is depressed in the same manner, if it is depressed in a different interval, an excess or shortage of fuel is generated because the structure of air-drawing portion of the engine 101 including intake manifold 108 is different and drawing air amounts Q of the cylinders are also different.

There only exists, as a non-synchronous injection at the time of a rapid acceleration, a fuel injection based on assumption in which a constant amount of fuel is injected with respect to a specific cylinder when the rapid acceleration is determined.

Although a correction for increasing a fuel amount at the time of acceleration and a fuel amount by the non-synchronous fuel injection are determined by matching, it is difficult to set the optimum value which meets all of the driving conditions. Therefore, there is a fear that an air-fuel ratio varies depending upon a timing and an amount of depressing the accelerator pedal 104, which may deteriorate the exhaust gas.

Thereupon, there are conceivable control methods such as a method for varying a fuel injection ratio in accordance with a timing of depressing the accelerator pedal, and a method for varying a fuel injection amount in accordance with a speed of depressing the accelerator pedal. However, a huge number of matching data is necessary for determining the optimum fuel amount that meets every timing and amount of depressing the accelerator pedal and a program control logic is complicated, which is impractical.

Although the above description has been made while taking the case of acceleration, even at the time of deceleration, a deviation in the drawn air amount Q is generated as in the case of the acceleration, depending upon a closing timing of the throttle vale 106.

Although there is not shown here in the drawings, there has also been developed a throttle control apparatus which electronically control the operation of the throttle valve 106 in accordance with an accelerator pedal opening degree $\alpha$ using a throttle actuator having a motor, without using a mechanical transmission apparatus for adjusting a throttle opening degree $\theta$.

In this case, the throttle valve 106 actually controls in accordance with a target throttle opening degree, after a predetermined time period (delay time) is elapsed after the accelerator pedal 104 is operated. A follow-up speed of the throttle valve 106 is restrained by the maximum driving speed of the motor.

In the fuel injecting timing, it is conceivable to control the fuel injection amount at the current time, in view of a timing in which an injected fuel is actually drawn to the engine 101, and in view of a throttle opening degree after a predetermined delay time is elapsed. However, there has not been proposed to reliably supply a fuel injection amount in accordance with a drawn air amount when the fuel is drawn to the engine 101.

Therefore, it is impossible to accurately calculate an injection signal J in accordance with the drawn air amount by the operation of the throttle valve 106 after the predetermined time period is elapsed in response to the operation of the accelerator pedal 104. Particularly, it is extremely difficult to control the fuel injection amount at the time of transitional driving state in the most suitable manner.

As described above, in the conventional fuel injection control apparatus for an internal combustion engine, it is not impossible to calculate the optimum fuel injection amount in accordance with an actual drawn air amount during a transitional driving state and therefore, there is a problem that an air-fuel ratio is deviated and an exhaust gas is deteriorated.

Further, even if an attempt is made to variably control a fuel injection amount in accordance with a timing or a speed of depressing the accelerator pedal 104, because a huge number of matching data is required, there is a problem that a program control logic is complicated.

SUMMARY OF THE INVENTION

The present invention has been accomplished in view of the above described problems, and it is an object of the invention to provide to provided a fuel injection control apparatus for an internal combustion engine in which a deviation of an air-fuel ratio is suppressed and an exhaust gas is improved by calculating the optimum fuel injection amount in accordance with an actual drawn air amount, in spite of difference in operation of the accelerator pedal during a transitional driving state.

A fuel injection control apparatus for an internal combustion engine according to the present invention comprises: a throttle actuator including a throttle valve for adjusting a drawn air amount to be drawn into the internal combustion engine; an injector for adjusting a fuel injection amount to be injected to the internal combustion engine; various sensors for detecting a driving state of the internal combustion engine; and a control unit for calculating control amounts of the throttle actuator and the injector in accordance with the driving state; wherein the various sensors include: a throttle opening degree sensor for detecting an operating amount of the throttle valve as a throttle opening degree; an accelerator pedal opening degree sensor for detecting a depression amount of an accelerator pedal as an accelerator pedal opening degree; and a crank angle sensor for detecting a crank angle signal indicative of a crank angle reference position for every cylinder; the control unit calculates a target throttle opening degree corresponding to the control amount of the throttle actuator based on the accelerator pedal opening degree, and includes: a throttle control apparatus for controlling an opening degree of the throttle valve toward the target throttle opening degree; engine revolution number detecting means for calculating the engine revolution number based on the crank angle signal; and an injector control apparatus for calculating a target fuel injection amount corresponding to the control amount of the injector based on the engine revolution number and the throttle opening degree, and for controlling the fuel injection amount of the injector toward the target fuel injection amount; and wherein the injector control apparatus includes: expected engine revolution number calculating means for calculating the expected engine revolution number for a predetermined interval based on the engine revolution number; expected throttle opening degree calculating means for calculating an expected throttle opening degree for the predetermined interval based on the throttle opening degree; expected drawn air amount calculating means for calculating an expected drawn air amount for the predetermined interval based on the expected engine revolution number and the expected throttle opening degree; and target fuel injection amount calculating means for calculating the target fuel injection amount based on the expected drawn air amount.

The expected throttle opening degree calculating means calculates the expected throttle opening degree based on the throttle opening degree and the target throttle opening degree.

The expected throttle opening degree calculating means calculates an expected throttle opening degree of an intermediate point of an air-drawing process of each of the cylinders.

The expected throttle opening degree calculating means calculates an average value of expected throttle opening degrees of a start point and an end point of an air-drawing process of each of the cylinders.

The various sensors include a drawn air amount sensor for detecting the drawn air amount, the injector control apparatus includes expected drawn air amount correcting means for correcting the expected drawn air amount based on the drawn air amount, and the target fuel injection amount calculating means calculates the target fuel injection amount based on an expected drawn air amount corrected by the expected drawn air amount correcting means.

The expected drawn air amount correcting means outputs, as a corrected expected drawn air amount, a value obtained by adding a variation amount of the expected drawn air amount to the drawn air amount.

The expected drawn air amount correcting means outputs, as a corrected expected drawn air amount, a value obtained by multiplying the drawn air amount by a variation ratio of the expected drawn air amount.

The target throttle opening degree calculating means outputs the target throttle opening degree after a predetermined delay time is elapsed from a timing for detecting the accelerator pedal opening degree.

The delay time corresponds to a predetermined crank angle. The delay time is set equal to or greater than a length corresponding to a time period from a fuel injection starting timing which is synchronous with the crank angle signal to an intermediate point of the next air-drawing process.

DETAILED DESCRIPTION OF THE PREFERRED EMBODIMENTS

First Embodiment

A first embodiment of the present invention will be described with reference to the accompanying drawings.

Figure 1:
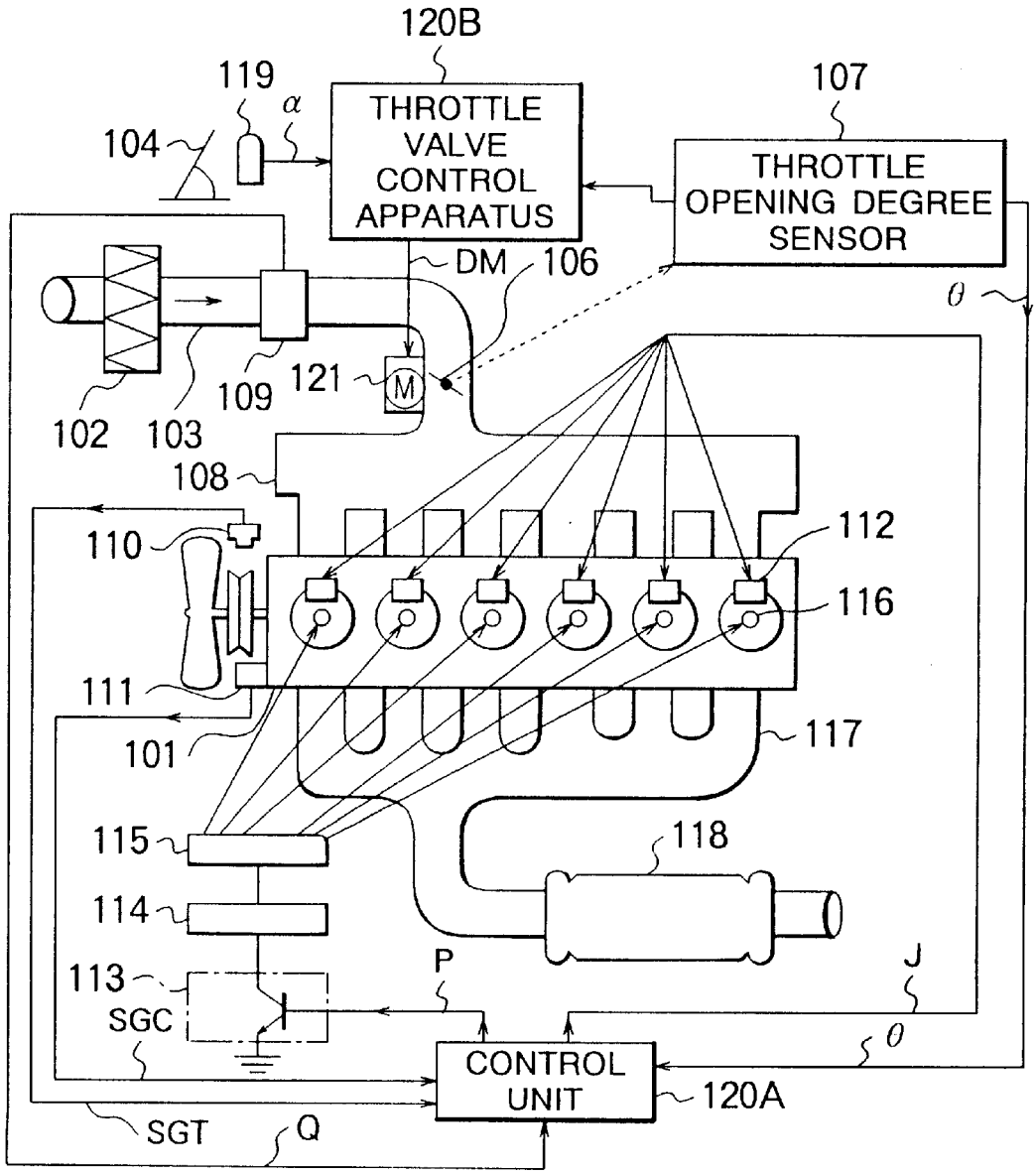
FIG. 1 is a view for showing a structure according to a first embodiment of the present invention.
Figure 7:
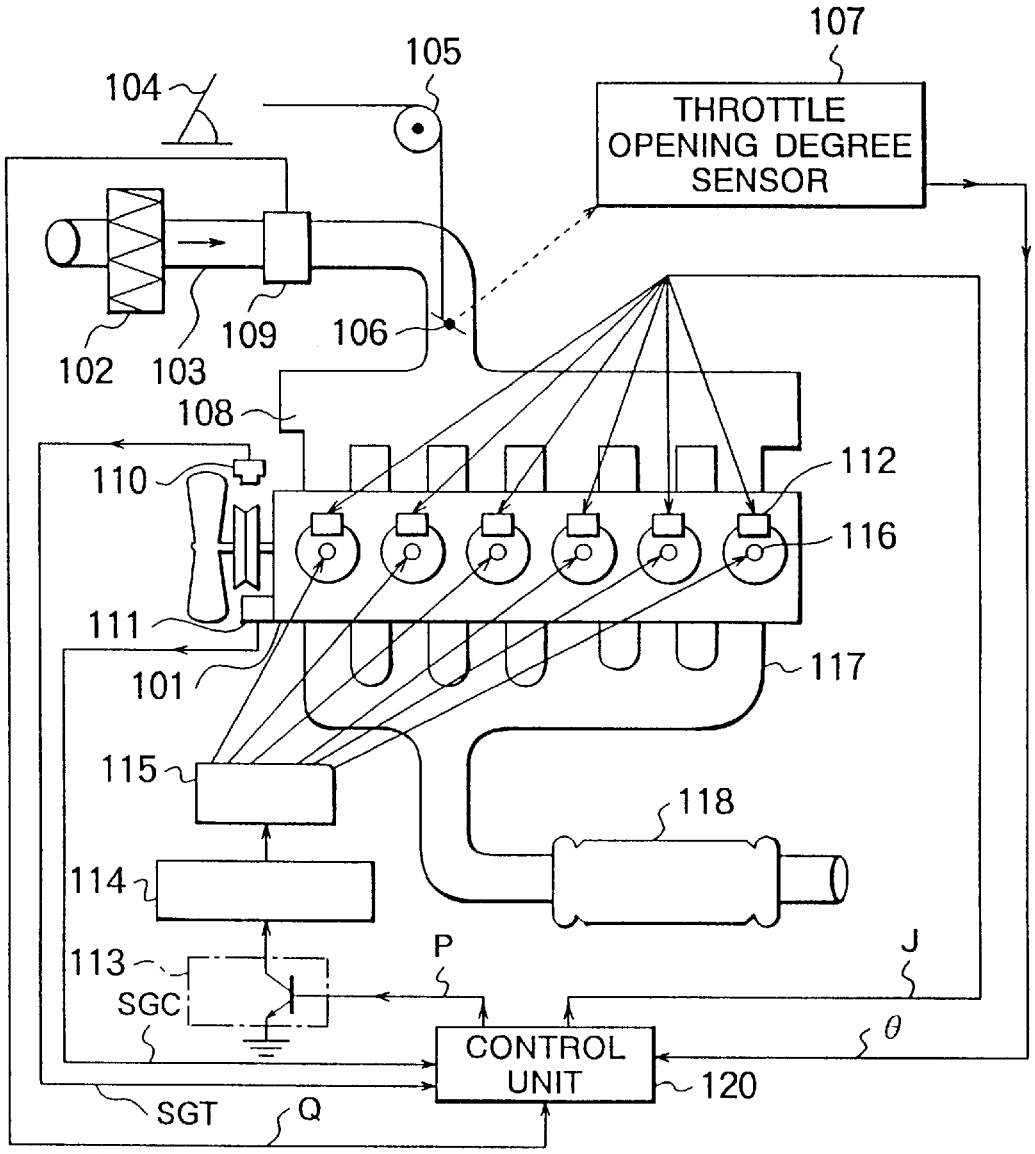
PRIOR ART FIG. 7
FIG. 7 is a view for showing a structure of a conventional fuel injection control apparatus for an internal combustion engine.

FIG. 1 shows a structure of the first embodiment of the invention, and elements which are similar to those described above (see FIG. 7) are designated with similar reference numbers, and their detailed explanations will be omitted.

In FIG. 1, an accelerator pedal opening degree sensor 119 detects an operated position of the accelerator pedal 104 as an accelerator pedal opening degree $\alpha$.

A throttle control apparatus 120B comprises a microcomputer as the control unit 120A does, and produces a driving signal DM with respect to a motor 121 and controls an operation of a throttle valve 106.

The motor 121 constitutes a throttle actuator together with the throttle valve 106, and electronically adjusts a throttle opening degree $\theta$.

The throttle control apparatus 120B may be included as a portion of a function of the control unit 120A. The throttle control apparatus 120B calculates a target throttle opening degree $\theta m$ in accordance with the accelerator pedal opening degree $\alpha$ from the accelerator pedal opening degree sensor 119, and feedback-controls the throttle opening degree $\theta$ such that the latter coincides with the target throttle opening degree $\theta m$.

Figure 2:
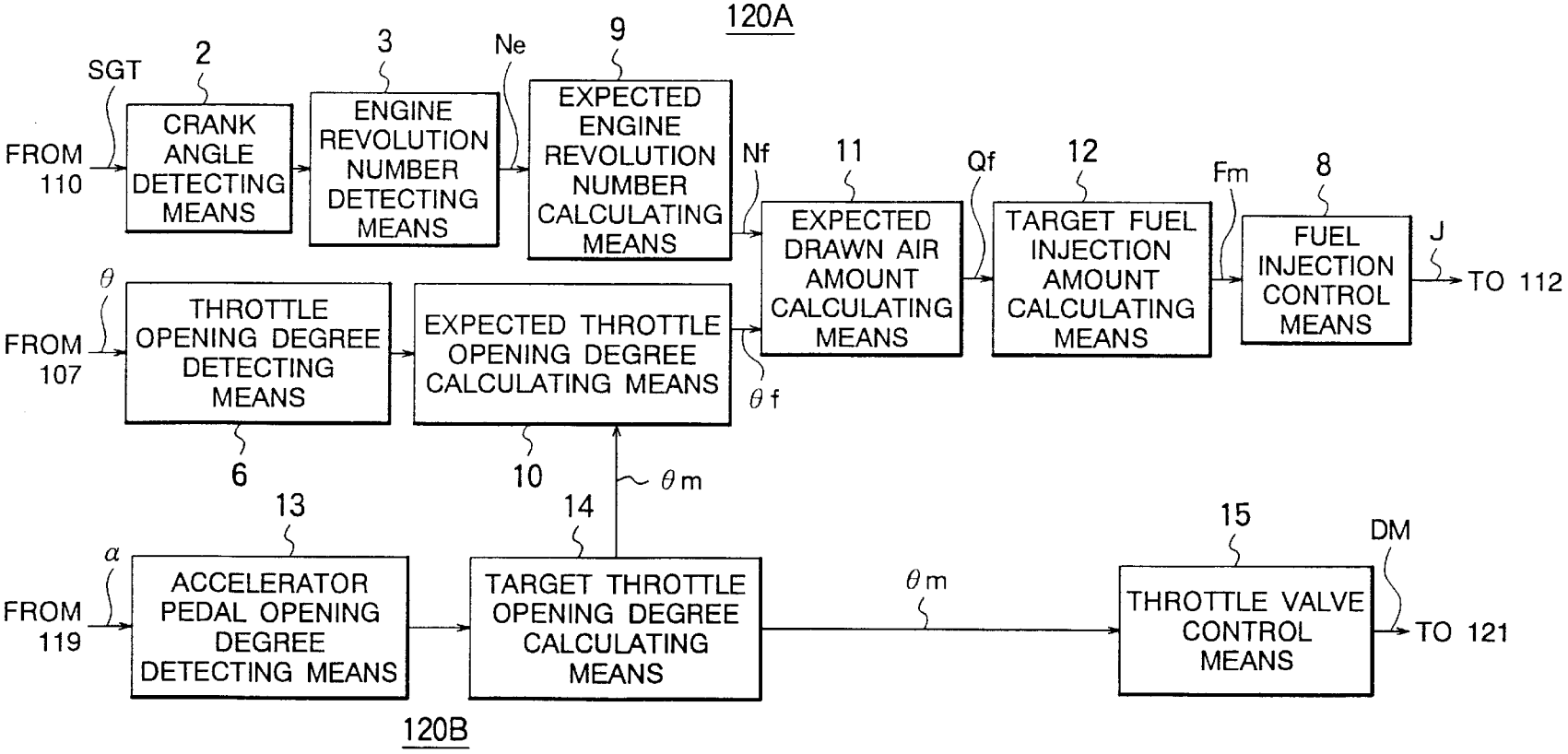
FIG. 2 is a block diagram showing a functional structure of an essential portion of the first embodiment of the invention.
Figure 8:
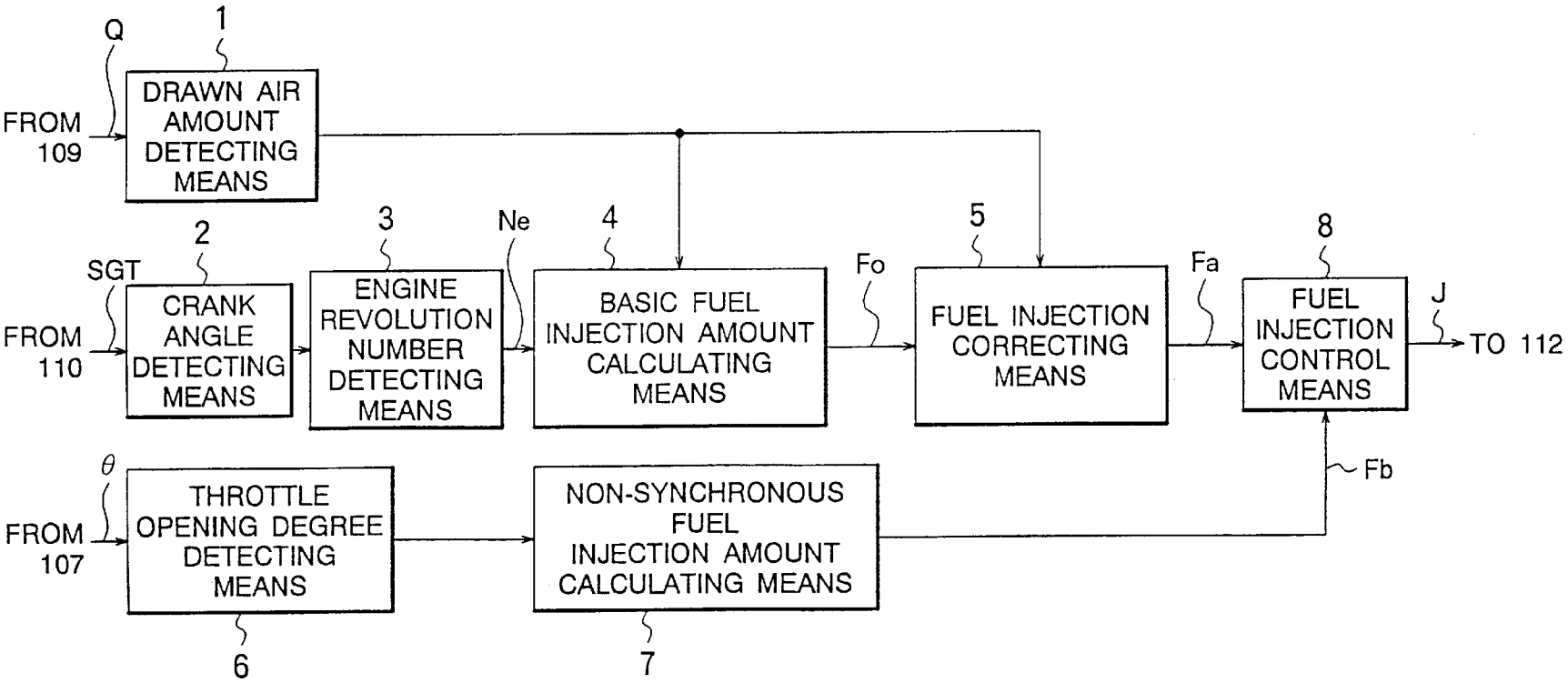
PRIOR ART FIG. 8
FIG. 8 is a block diagram for showing a functional structure of an essential portion of the conventional fuel injection control apparatus for the internal combustion engine.
Figure 9:
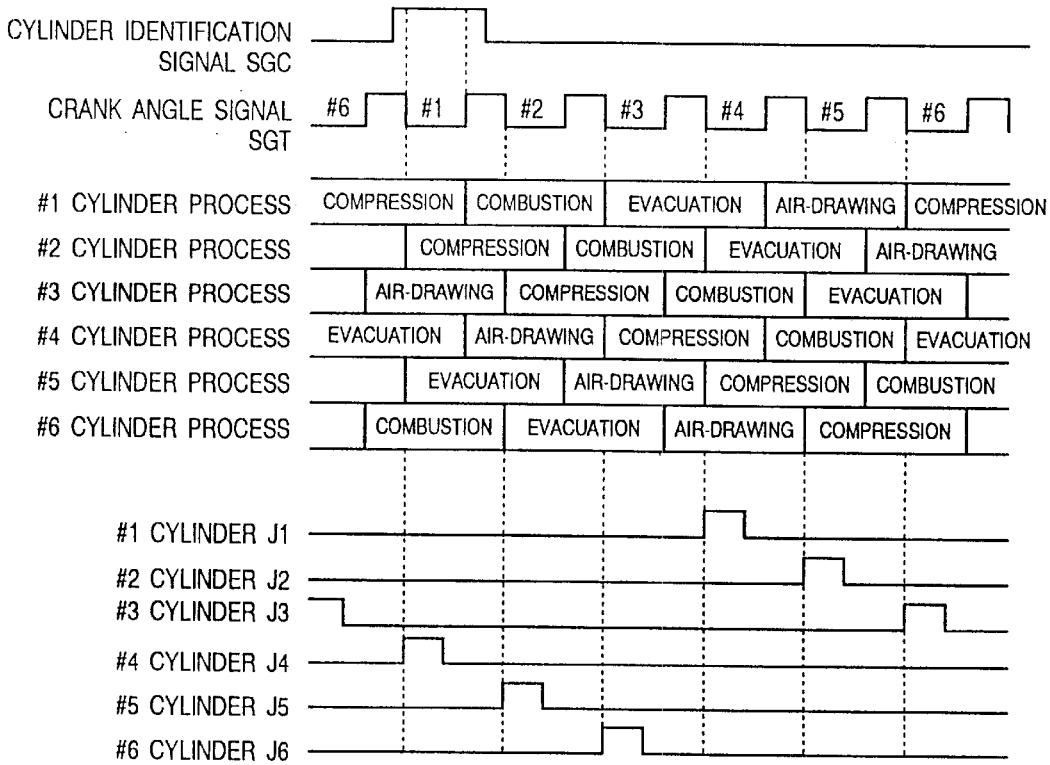
PRIOR ART FIG. 9
FIG. 9 is a timing chart for explaining a normal operation of the conventional fuel injection control apparatus for the internal combustion engine.
Figure 10:
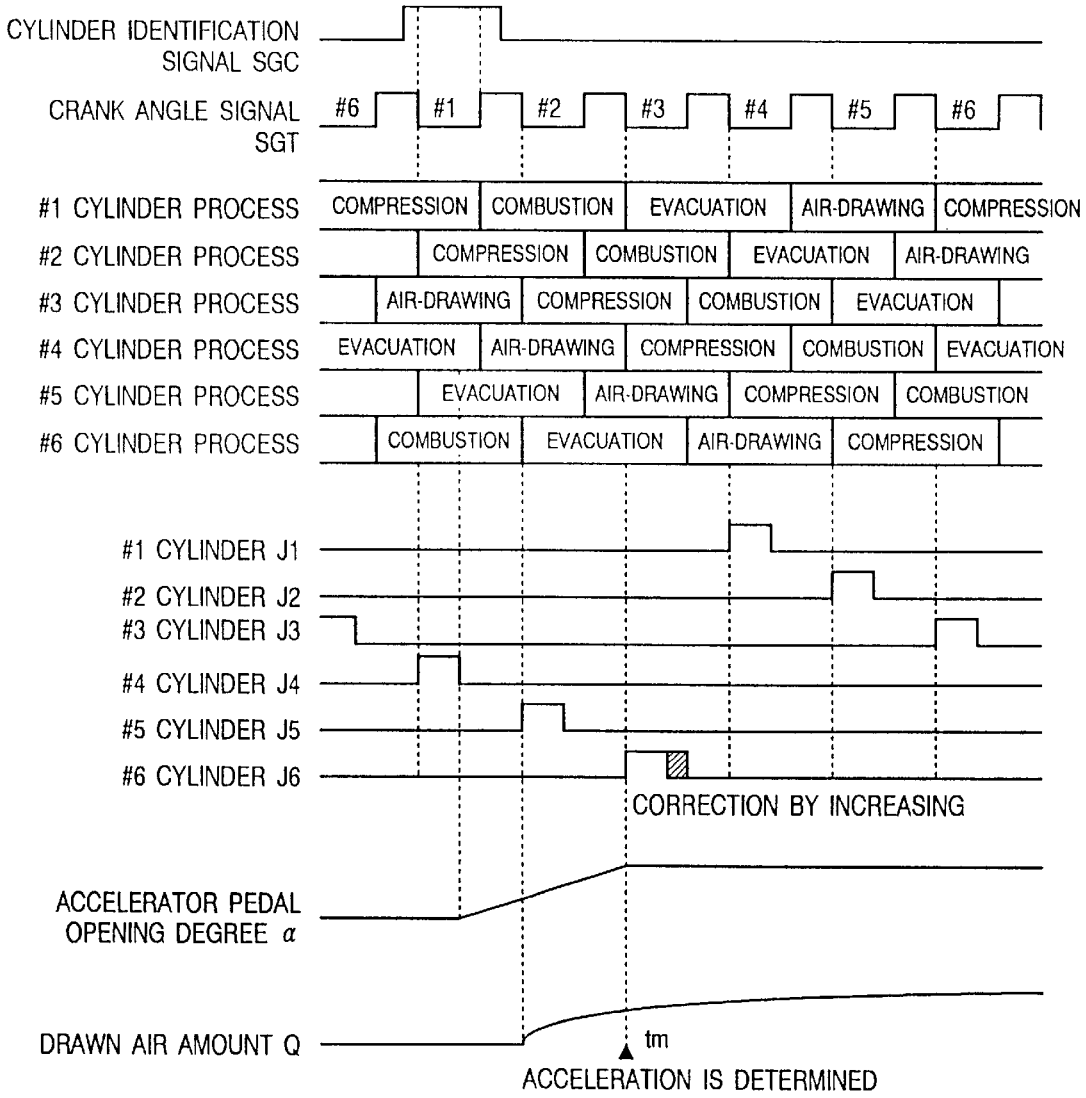
PRIOR ART FIG. 10
FIG. 10 is a timing chart for explaining a accelerating operation of the conventional fuel injection control apparatus for the internal combustion engine.
Figure 11:
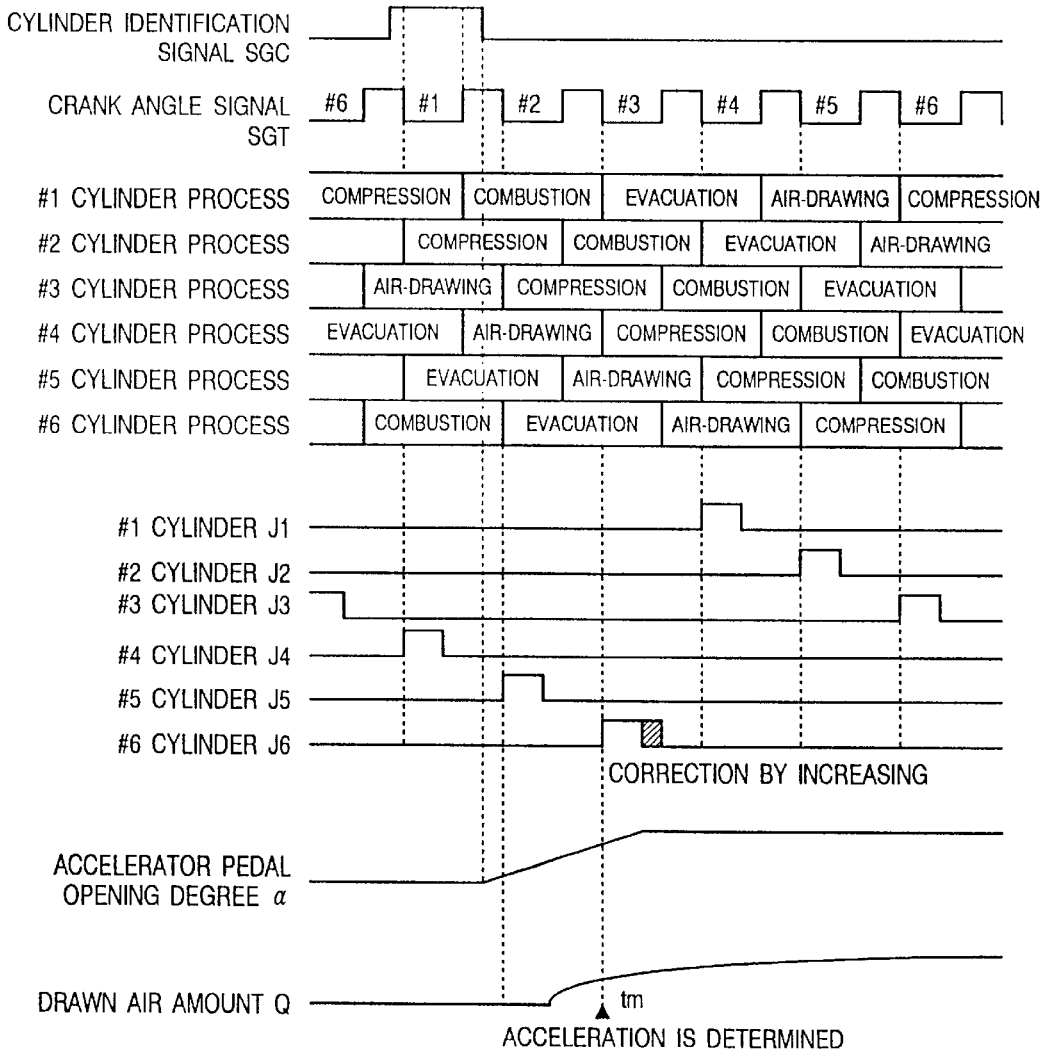
PRIOR ART FIG. 11
FIG. 11 is a timing chart for explaining a accelerating operation of the conventional fuel injection control apparatus for the internal combustion engine.
Figure 12:
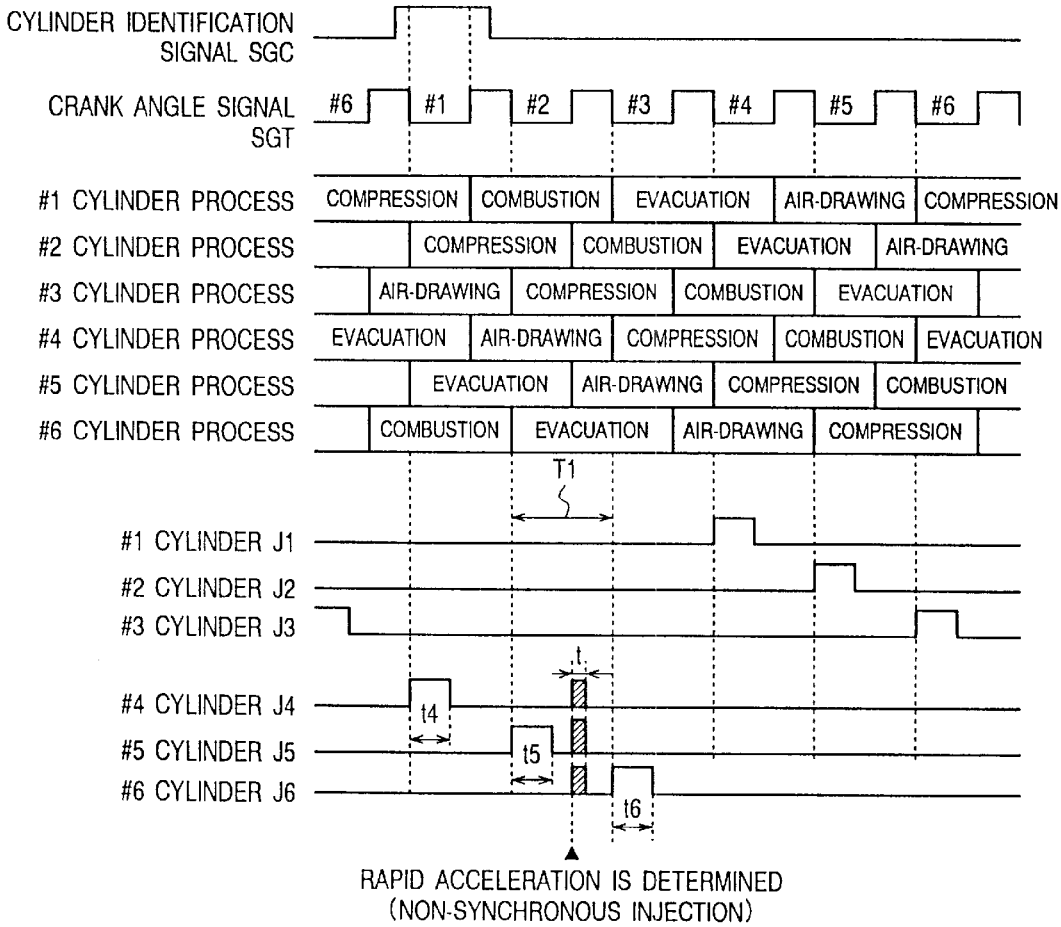
PRIOR ART FIG. 12
FIG. 12 is a timing chart for explaining a non-synchronous fuel injecting operation at the time of rapid acceleration of the conventional fuel injection control apparatus for the internal combustion engine.
Figure 13:
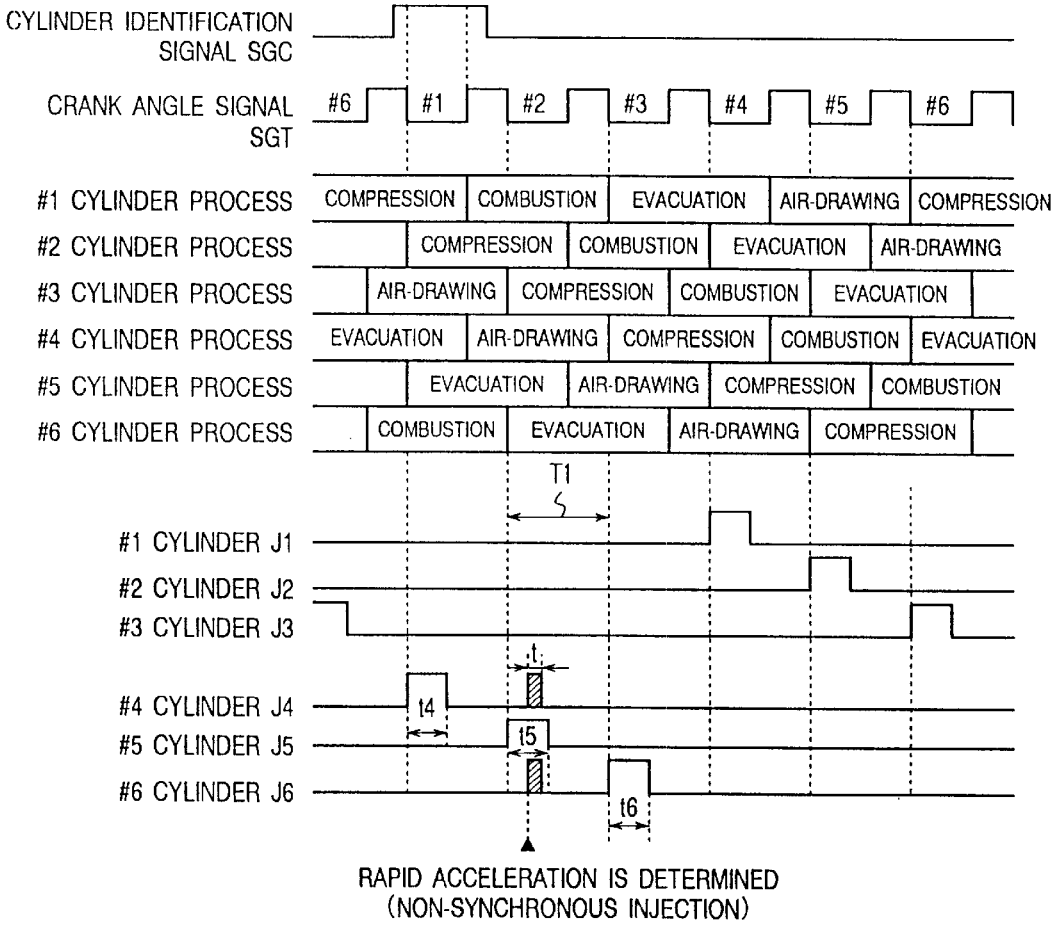
PRIOR ART FIG. 13
FIG. 13 is a timing chart for explaining a non-synchronous fuel injecting operation at the time of rapid acceleration of the conventional fuel injection control apparatus for the internal combustion engine.
Figure 14:
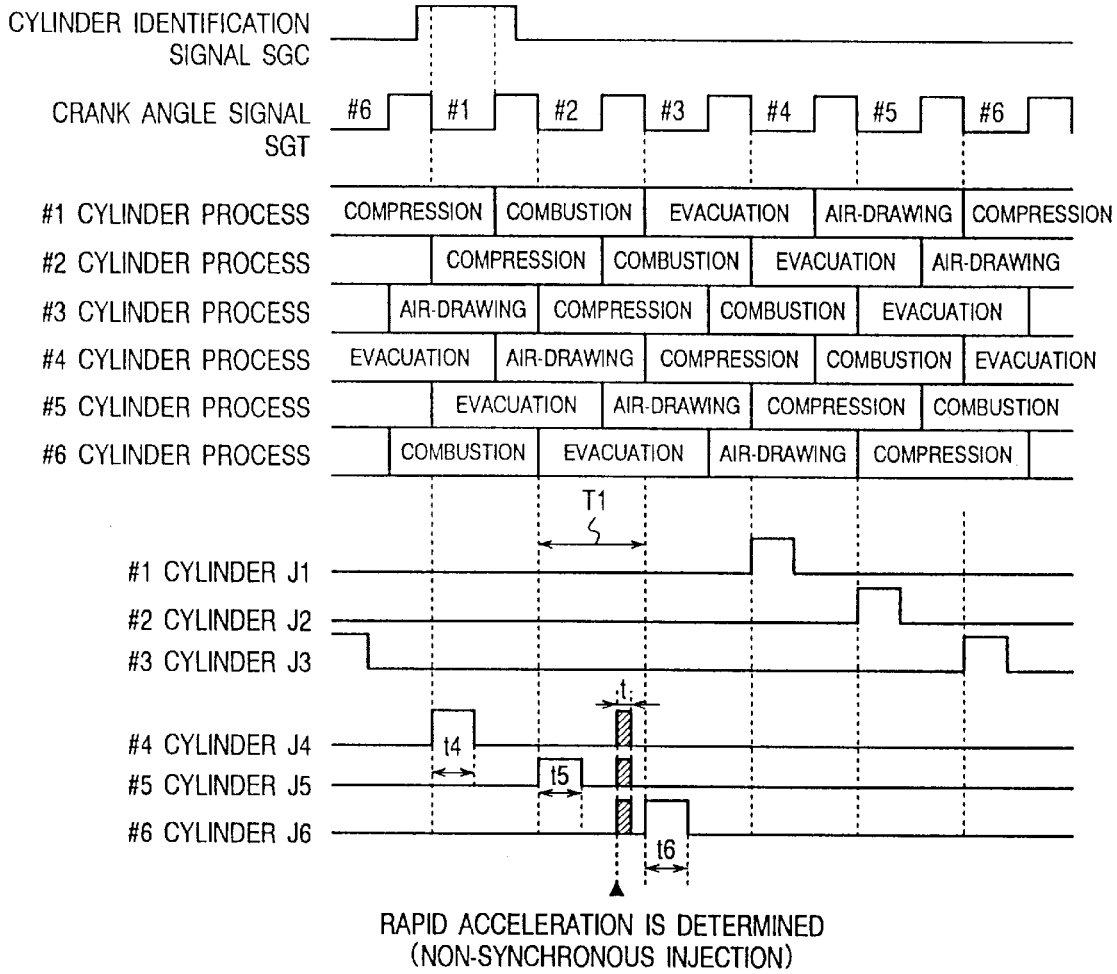
PRIOR ART FIG. 14
FIG. 14 is a timing chart for explaining a non-synchronous fuel injecting operation at the time of rapid acceleration of the conventional fuel injection control apparatus for the internal combustion engine.

FIG. 2 is a block diagram showing a basic functional structure of the control unit 120A and the throttle control apparatus 120B according to the first embodiment, and elements which are similar to those described above (see FIG. 8) are designated with similar reference numbers, and their detailed explanations will be omitted.

In FIG. 2, an injector control apparatus in the control unit 120A includes expected engine revolution number calculating means 9 for calculating an expected engine revolution number Nf, expected throttle opening degree calculating means 10 for calculating an expected throttle opening degree $\theta$, expected drawn air amount calculating means 11 for calculating an expected drawn air amount Qf, and target fuel injection amount calculating means 12 for calculating a target fuel injection amount Fm.

The expected engine revolution calculating means 9 estimates and calculates the expected engine revolution number Nf during a predetermined interval (e.g., air-drawing process as described below) based on the engine revolution number Ne.

The expected throttle opening degree calculating means 10 estimates and calculates the expected throttle opening degree $\theta f$ during an air-drawing process of each of cylinders based on the throttle opening degree $\theta$ and the target throttle opening degree $\theta m$.

The expected drawn air amount calculating means 11 estimates and calculates the expected drawn air amount Qf during the air-drawing process of each of the cylinders based on the expected engine revolution number Nf and the expected throttle opening degree θf.

The target fuel injection amount calculating means 12 calculates the target fuel injection amount Fm which corresponds to a control amount of the injector 112 based on the expected drawn air mount Qf.

The fuel injection control means 8 produces an injection signal J which corresponds to the target fuel injection amount Fm.

With the above-described arrangement, the injector 112 is controlled such that the fuel injection amount coincides with the target fuel injection amount Fm.

The throttle control apparatus 120B included in the control unit 120A includes accelerator pedal opening degree detecting means 13 for detecting the accelerator pedal opening degree α as a detected value, target throttle opening degree calculating means 14 for calculating the target throttle opening degree θm based on the accelerator pedal opening degree α, and throttle valve control means for producing a driving signal DM based on the target throttle opening degree θm.

The accelerator pedal opening degree detecting means 13 functions as an input I/F concerning the accelerator pedal opening degree α from the accelerator pedal opening sensor 119, and calculates an actual accelerator pedal opening degree from a signal indicative of the accelerator pedal opening degree α.

The target throttle opening degree calculating means 14 calculates a control amount of the throttle actuator after a predetermined delay time Td is elapsed, i.e., the target throttle opening degree θm of the throttle valve 106.

The delay time Td is a time period from a time point when the accelerator pedal 104 is operated to a time point when the throttle valve 106 is actually controlled.

The throttle valve control means 15 produces the driving signal DM of the motor 121 corresponding to the target throttle opening degree θm.

With the above-described arrangement, the throttle valve 106 is controlled such that the throttle opening degree θ coincides with the target throttle opening degree θm.

Next, an operation of the first embodiment of the invention shown in FIGS. 1 and 2 will be described with reference to timing charts in FIGS. 3 and 4.

Figure 3:
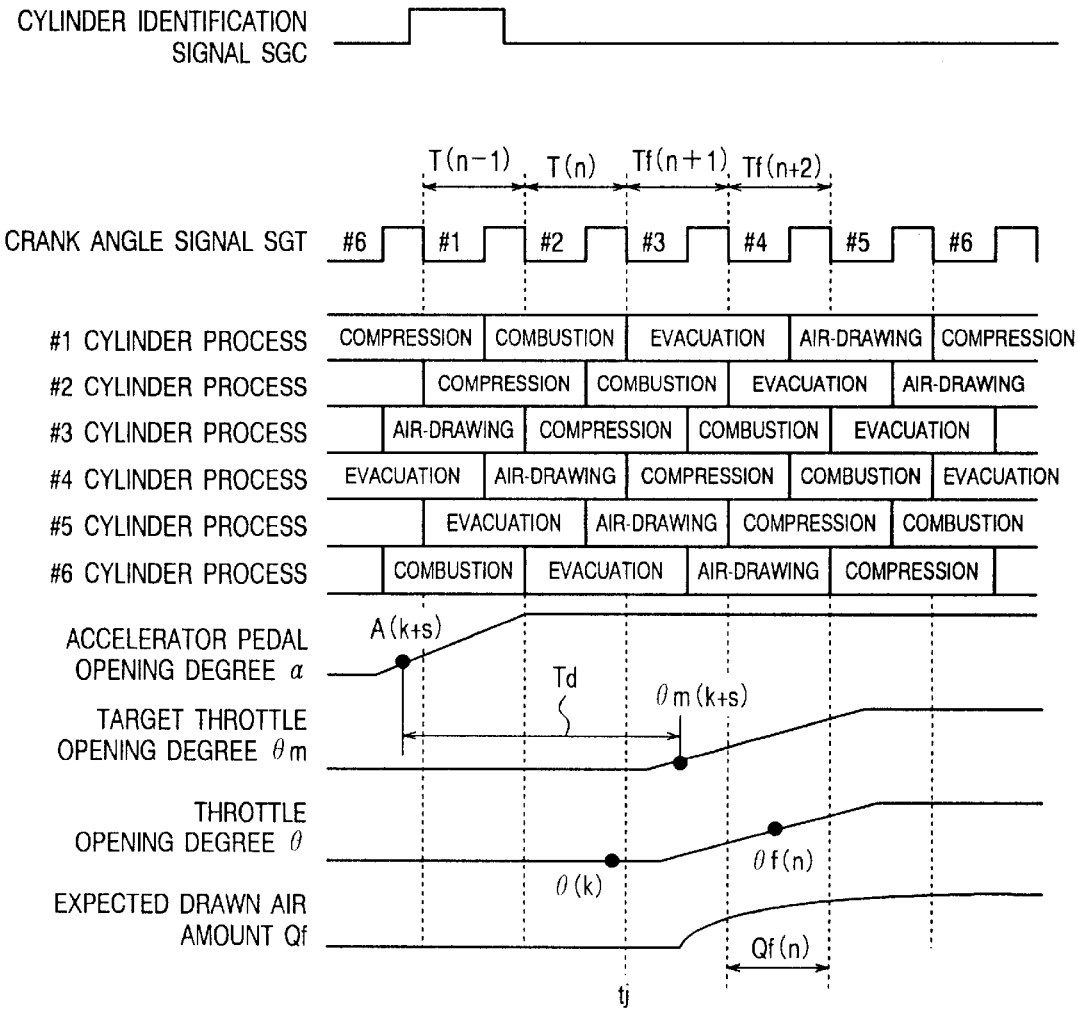
FIG. 3 is a timing chart for explaining an operation according to the first embodiment of the invention.

FIG. 3 shows a relationship between processes of each of the cylinders (#1 to #6) at the time of acceleration and variations in various parameters according to the first embodiment of the invention. Wave forms which are similar to those described above are designated with similar reference numbers, and their detailed explanations will be omitted.

Figure 4:
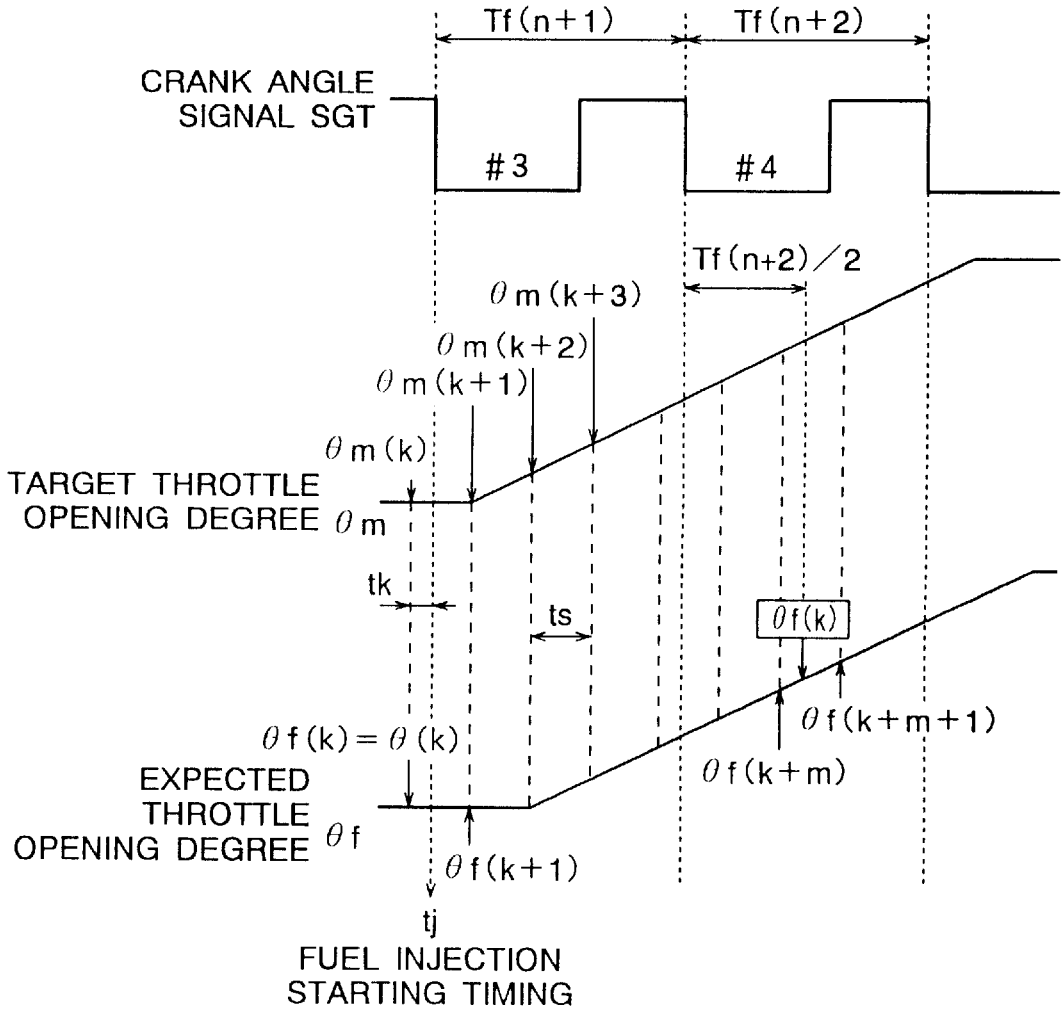
FIG. 4 is a timing chart for explaining an operation according to the first embodiment of the invention.

FIG. 4 shows an operation of the expected throttle opening degree calculating means 10 according to the first embodiment, and shows a relationship between the target throttle opening degree θm and the expected throttle opening degree θf.

The throttle opening degree θm which is a control amount of the throttle valve 106 is immediately calculated with respect to the accelerator pedal opening degree α, but the throttle opening degree θm is produced or output after a predetermined delay time Td is elapsed in view of an electronic delay time required for the calculation and a mechanical follow-up delay time required for driving the motor 121.

The throttle valve 106 is controlled after the delay time Td is elapsed after the accelerator pedal 104 is operated. The throttle opening degree θ is set at the target throttle opening degree θm by the driving signal DM produced from the throttle control apparatus 120B.

As shown in FIG. 3, the expected engine revolution number calculating means 9 in the injector control apparatus estimates and calculates the expected engine revolution number Nf during the air-drawing process of a cylinder which is the subject of fuel injection at a timing (time tj) which is prior to the air-drawing process.

In FIG. 3, paying attention to #6 cylinder for example, at falling-down time tj of the crank angle signal SGT (timing for starting fuel injection for #6 cylinder), the next expected cycle Tf(n+1) is first calculated based on the current time measuring cycle T(n) and the last time measuring cycle T(n−1) between falling-down edges of the crank angle signal SGT.

Subsequently, the next time but one expected cycle Tf(n+2) is calculated which corresponds to a air-drawing process of #6 cylinder based on the current time measuring cycle T(n) and the next time expected cycle Tf(n+1), and the calculated expected cycle Tf(n+2) is converted into engine revolution number, thereby calculating the expected engine revolution number Nf(n+2) during the air-drawing process of #6.

Similarly, the expected throttle opening degree calculating means 10 in the injector control apparatus estimates and calculates, at the time tj, the expected throttle opening degree θf during the air-drawing process of a cylinder which is the subject of the fuel injection.

More specifically, the expected throttle opening degree θf(n) at an intermediate point of the air-drawing process of #6 cylinder, based on the latest throttle opening degree θ(k) detected at the current time (time ij) and target throttle opening degrees θm(k+s) (s=1, 2, . . . ) at intervals of predetermined time ts (at calculating cycle of about 10 m seconds).

Here, the target throttle opening degree θm(k+s) has already been calculated and determined based on the accelerator pedal opening degree α detected before a time period corresponding to the delay time Td (see FIG. 3).

Therefore, the expected throttle opening degree calculating means 10 estimates and calculates the expected throttle opening degree θf, based on a throttle opening degree θ which has been detected at the current time, and a future target throttle opening degree θm in accordance with an accelerator pedal opening degree α which has been detected at the current time.

On the other hand, there exists, e.g., a predetermined mechanical delay time ta between a target throttle opening degree θm which is output from the target throttle opening degree calculating means 14 in the throttle control apparatus and a throttle opening degree θ which is detected after the throttle valve is controlled by the throttle valve control means 15.

A description will be made here provided that the delay time ta satisfies the equation of ta=ts (about 10 m seconds).

In order to calculate an expected throttle opening degree θf(n) at a time n (intermediate point) that is to be calculated, the expected throttle opening degree calculating means 10 first calculates expected throttle opening degrees θf(k+s) at intervals of predetermined time ts based on a certain time k as a reference.

More specifically, if a relationship between the target throttle opening degrees θm(k+s) at intervals of the predetermined time ts (at intervals of time (k+s)) and a throttle opening degree θ(k) which is actually detected at time k satisfies a condition of θm(k+s)>θ(k), the expected throttle opening degree θf(k) at the time k and the expected throttle opening degrees θf(k+s) at intervals of the predetermined time ts are calculated according to the following equations (1):

$$\theta f(k)=\theta(k)$$

$$\theta f(k+s)=\min\{\theta m(k+s-1),\ \theta f(k+s-1)+\Delta\theta\max\} \quad (1)$$

wherein in the equation (1), Δθmax is the maximum variation amount of a throttle opening degree θ when the throttle actuator is controlled. Further, an expression "min{X,Y} means that the smaller one of X and Y is selected.

The equation (1) is used when the next time target throttle opening degree θm(k+s) is greater than a throttle opening degree θ(k) which is detected at the current time, i.e., when the throttle valve 106 is opened.

On the other hand, if a relationship between the target throttle opening degree θm(k+s) and the actual throttle opening degree θ(k) satisfies a condition of θm(k+s)≦θ(k), the expected throttle opening degree θf(k) at the time k and the expected throttle opening degrees θf(k+s) at intervals of the predetermined time ts are calculated according to the following equations (2):

$$\theta f(k)=\theta(k)$$

$$\theta f(k+s)=\max\{\theta m(k+s-1),\ \theta f(k+s-1)-\Delta\theta\max\} \quad (2)$$

wherein in the equation (2), an expression "max{X,Y} means that the greater one of X and Y is selected.

The equation (2) is used when the next time target throttle opening degree θm(k+s) is equal to or smaller than a throttle opening degree θ(k) which is detected at the current time, i.e., when the throttle valve 106 is closed or unchanged.

In each of the cases of the equations (1) and (2), a variation amount of the expected throttle opening degree θm is limited by the actual maximum opening degree variation amount Δθmax of the throttle valve 106.

Subsequently, the expected throttle opening degree calculating means 10 calculates an expected throttle opening degree θf(n) at an intermediate point of the air-drawing process of #6 cylinder at falling-down time tj of the crank angle signal SGT based on the expected cycles Tf(n+1), Tf(n+2) and the expected throttle opening degrees θf(k+s) at intervals of the predetermined time ts.

Here, paying attention to #6 cylinder for the sake of convenience, an intermediate point of the air-drawing process of #6 cylinder (a timing at which a fuel injection is actually reflected) is defined as an intermediate point of a interval of the next-but-one expected cycle Tf(n+2).

For example, when an expected throttle opening degrees θf(k+s) are calculated at intervals of 10 ms, an expected throttle opening degree θf(n) at time n is calculated by interpolation of m-th expected throttle opening degree θf(k+m) as counted from time k and m+1-th expected throttle opening degree θf(k+m+1) according to the following equation (3):

$$\theta f(n)=\theta f(k+m)+\{\theta f(k+m+1)-\theta f(k+m)\}\times\{(tk+Tf(n+1)+Tf(n+2)/2\}-10\cdot m\}/10 \quad (3)$$

wherein in the equation (3), tk is an elapsed time from a time point at which the throttle opening degree θ(k) is detected to a time point tj (see FIG. 4).

Further, m is a value based on the expected cycle Tf(n+1) and Tf(n+2), and is expressed as shown in the following equation (4):

$$m=(tk+Tf(n+1)+Tf(n+2)/2)/10 \quad (4)$$

Next, the expected drawn air amount calculating means 11 calculates an expected drawn air amount Qf(n) of a cylinder to which a fuel is injected, based on an expected throttle opening degree θf(n) and an expected engine revolution number Nf(n+2).

Lastly, the target fuel injection amount calculating means 12 calculates a target fuel injection amount Fm(n) based on the expected drawn air amount Qf(n), and the fuel injection control means 8 outputs a fuel injection signal J corresponding to the target fuel injection amount Fm(n), thereby controlling a fuel injection with respect to the corresponding cylinder.

As described above, an expected drawn air amount Qf of a cylinder to which a fuel is injected is calculated based on the expected throttle opening degree θf of the cylinder to which a fuel is injected, and based on the expected engine revolution number Nf, thereby determining a target fuel injection amount Fm.

With the above-described arrangement, it is unnecessary to conduct a control of fuel correction or non-synchronous injection based on assumption as in the conventional apparatus having a low reliability. Further, even during a transitional driving state, it is possible to suppress a deviation in air-fuel ratio, and to improve an exhaust gas.

In the first embodiment, the target throttle opening degree calculating means 14 calculates and output a target throttle opening degree θm after the predetermined delay time Td is elapsed from a time point at which an accelerator pedal opening degree α is detected. Alternatively, the target throttle opening degree calculating means 14 may calculate and output a target throttle opening degree θm after a follow-up time corresponding to a predetermined crank angle is elapsed, in view of the fact that the delay time Td is related to the engine revolution number Ne. With the latter measures, it is possible to set the optimum delay time Td irrespective of a difference in the engine revolution number Ne.

Further, although the expected throttle opening degree calculating means 10 calculates an expected throttle opening degree θf at an intermediate point of the air-drawing process, an average value of expected throttle opening degrees detected between a start point and an end point of the air-drawing process may be employed as the expected throttle opening degree θf.

The delay time Td is set to be a value which is at least equal to or longer than a length corresponding to a period from a fuel injection starting timing tj to an intermediate point of a next air-drawing process.

With this arrangement, it is possible to reliably start injecting a fuel before a throttle opening degree θ actually rises in response to an accelerator pedal opening degree α irrespective of a difference in operation timing of the accelerator pedal 104.

Further, because a calculation of the expected drawn air amount Qf(n) and a calculation of the target fuel injection amount Fm(n) based on the expected drawn air amount Qf(n) can be conducted in an extremely short time as compared with a cycle of the engine process, such calculations can be executed at the fuel injection starting timing tj. Therefore, it is possible to reflect the engine revolution number Ne or the like at the time of fuel injection starting time tj, and to realize a precise fuel injection control.

Second Embodiment

Although the expected drawn air amount Of is calculated based on only the expected throttle opening degree θf and the expected engine revolution number Nf according to the above-described first embodiment, it is also possible to calculated an expected drawn air amount Qfa as corrected based on a variation state of the expected drawn air amount Of and a detected value of actual drawn air amount Q.

The variation state of the expected drawn air amount Qf and the actual drawn air amount Q reflect a driving state at the time of detection. Therefore, by obtaining the expected drawn air amount Qfa based on the variation state of the expected drawn air amount Qf and the actual drawn air amount Q, it is possible to determine a further precise target fuel injection amount Fm.

Figure 5:
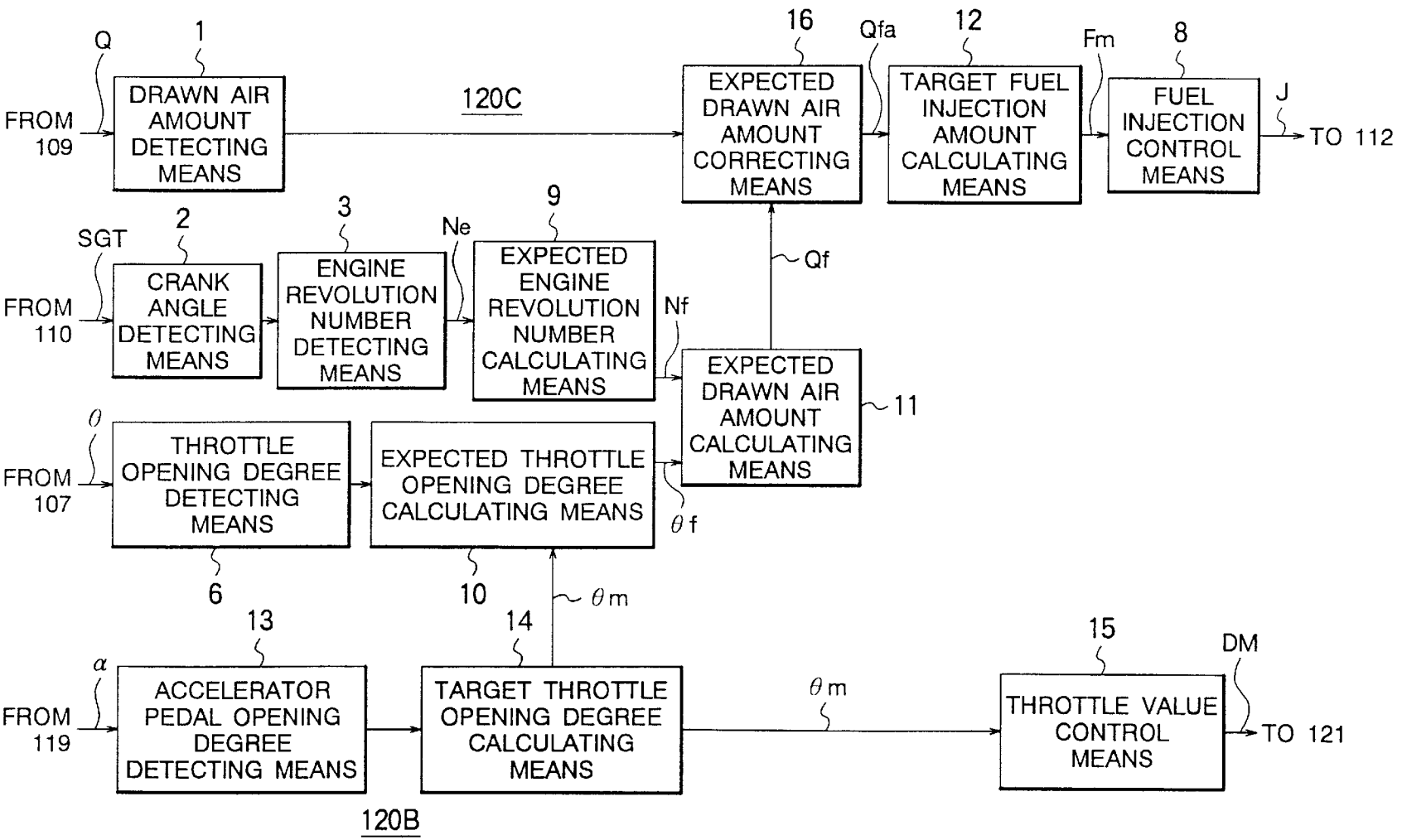
FIG. 5 is a view for showing a structure according to a second embodiment of the present invention.

FIG. 5 is a block diagram showing an essential structure of the second embodiment of the present invention in which the expected drawn air amount Of is corrected based on the drawn air amount Q. Elements which are similar to those described above (see FIG. 1) are designated with similar reference numbers, and their detailed explanations will be omitted.

As in the first embodiment, a control unit 120C may include the throttle control apparatus 120B.

In FIG. 5, an expected drawn air amount correcting means 16 corrects an expected drawn air amount Of from an expected drawn air amount calculating means 11 based on an drawn air amount Q detected by a drawn air amount detecting means 1, and outputs an expected drawn air amount Qfa as corrected.

A target fuel injection amount calculating means calculates a target fuel injection amount Fm based on the corrected expected drawn air amount Qfa.

Next, an operation of the second embodiment of the invention will be described with reference to a timing chart in FIG. 6.

Figure 6:
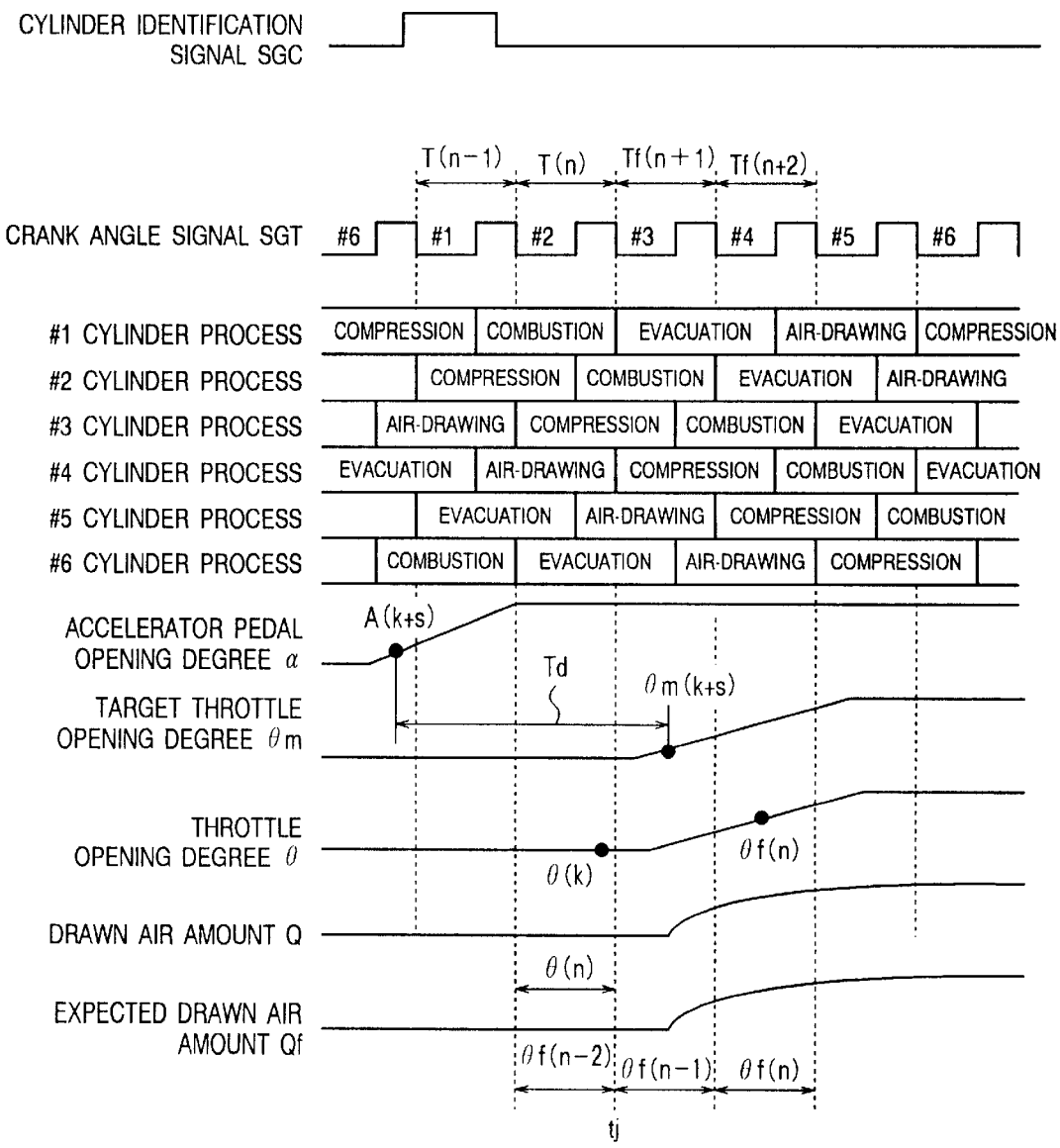
FIG. 6 is a timing chart for explaining an operation according to the second embodiment of the invention.

FIG. 6 shows a relationship between processes of cylinders of the engine 101, and detected signals α, θ and Q, as well as a target throttle opening dgree θm and an expected drawn air amount Qf. Wave forms which are similar to those described above (see FIG. 3) are designated with similar reference numbers, and their detailed explanations will be omitted.

In this case, the expected drawn air amount Qfa used for calculating the target fuel injection amount Fm is set based on not only the various calculating means 9 to 11, but also the expected drawn air amount correcting means 16 as will be described below.

First, at a falling-down point tj (see FIG. 6) of the crank angle signal SGT which is a fuel injection starting timing of #6 cylinder, the expected drawn air amount calculating means 11 calculates the expected drawn air amount Qf(n) as described above.

Further, the expected drawn air amount correcting means 16 corrects the expected drawn air amount Qf(n) from the drawn air amount Q(n) detected at time tj, and corrects and calculates the expected drawn air amount Qfa(n) used for calculating the target fuel injection amount Fm.

In this case, the expected drawn air amount Qfa(n) after correction is expressed as the following euqation (5):

$$Qfa(n)=Q(n)+\{Qf(n)-Qf(n-2)\} \quad (5)$$

That is, the expected drawn air amount Qfa(n) is a value obtained by adding, a variation amount {Qf(n)− Qf(n−2)} of the expected drawn air amount Qf, to the detected drawn air amount Q(n).

Then, at the falling-down time tj of the crank angle signal SGT, the target fuel injection amount calculating means 12 calculates the target fuel injection amount Fm(n) based on the corrected expected drawn air amount Qfa(n), and the fuel injection control means 8 conducts a fuel injection for the subject cylinder in accordance with the target fuel injection amount Fm(n).

As described above, by calculating the expected drawn air amount Qf from the expected engine revolution number Nf and the expected throttle opening degree θf of a cylinder to which a fuel is to be injected, calculating the corrected expected drawn air amount Qfa by adding the expected drawn air amount Qf to the drawn air amount Q, and determining the target fuel injection amount Fm from the expected drawn air amount Qfa, it is possible to control a fuel injection which also covers a varying element such as water temperature and drawn air temperature.

Therefore, it is unnecessary to conduct a control of fuel correction or non-synchronous injection as in the conventional apparatus having a low reliability. Further, during a normal driving state or a transitional driving state, it is possible to suppress a deviation in air-fuel ratio, and to improve an exhaust gas.

Although the corrected expected drawn air amount Qfa is calculated by adding, to the detected drawn air amount Q, a deviation between the current value Qf(n) and the last-but-one value Qf(n−2) of the expected drawn air amount Qf in the above equation (5), it is also possible to calculate the expected drawn air amount Qfa(n) by multiplying the detected drawn air amount Q(n) by a ratio of the last-but-one value (n−2) to the current value Qf(n) of the expected drawn air amount Qf as shown in the following equation (6):

$$Qfa(n)=Q(n)\times\{Qf(n)/Qf(n-2)\} \quad (6)$$

In this case, the expected drawn air amount Qfa(n) is a value obtained by multiplying the detected drawn air amount Q(n) by a ratio of variation amount {Qf(n)/Qf(n−2)} of the expected drawn air amount Qf.

As described above, by calculating the corrected expected drawn air amount Qfa by multiplying the drawn air amount Q by a ratio of the expected drawn air amount Qf, and by determining the target fuel injection amount Fm from the expected drawn air amount Qfa, it is possible to control a fuel injection which also covers a varying element such as water temperature and drawn air temperature.

The expected drawn air amount corrected means 16 may be included in a function of the expected drawn air amount calculating means 11 or in a function of the target fuel injection amount calculating means 12.

What is claimed is:

1. A fuel injection control apparatus for an internal combustion engine, comprising:

a throttle actuator including a throttle valve for adjusting a drawn air amount to be drawn into said internal combustion engine;

an injector for adjusting a fuel injection amount to be injected to said internal combustion engine;

various sensors for detecting a driving state of said internal combustion engine; and a control unit for calculating control amounts of said throttle actuator and said injector in accordance with said driving state; wherein said various sensors include:

a throttle opening degree sensor for detecting an operating amount of said throttle valve as a throttle opening degree;

an accelerator pedal opening degree sensor for detecting a depression amount of an accelerator pedal as an accelerator pedal opening degree; and a crank angle sensor for detecting a crank angle signal indicative of a crank angle reference position for every cylinder;

said control unit calculates a target throttle opening degree corresponding to the control amount of said throttle actuator based on said accelerator pedal opening degree, and includes:

a throttle control apparatus for controlling an opening degree of said throttle valve toward said target throttle opening degree;

engine revolution number detecting means for calculating the engine revolution number based on said crank angle signal; and an injector control apparatus for calculating a target fuel injection amount corresponding to the control amount of said injector based on said engine revolution number and said throttle opening degree, and for controlling the fuel injection amount of said injector toward said target fuel injection amount; and wherein said injector control apparatus includes:

expected engine revolution number calculating means for calculating the expected engine revolution number for a predetermined interval based on said engine revolution number;

expected throttle opening degree calculating means for calculating an expected throttle opening degree for said predetermined interval based on said throttle opening degree;

expected drawn air amount calculating means for calculating an expected drawn air amount for said predetermined interval based on said expected engine revolution number and said expected throttle opening degree; and target fuel injection amount calculating means for calculating said target fuel injection amount based on said expected drawn air amount.

2. A fuel injection control apparatus for an internal combustion engine according to claim 1, wherein said expected throttle opening degree calculating means calculates said expected throttle opening degree based on said throttle opening degree and said target throttle opening degree.

3. A fuel injection control apparatus for an internal combustion engine according to claim 1, wherein said expected throttle opening degree calculating means calculates an expected throttle opening degree of an intermediate point of an air-drawing process of each of said cylinders.

4. A fuel injection control apparatus for an internal combustion engine according to claim 1, wherein said expected throttle opening degree calculating means calculates an average value of expected throttle opening degrees of a start point and an end point of an air-drawing process of each of said cylinders.

5. A fuel injection control apparatus for an internal combustion engine according to claim 1, wherein said various sensors include a drawn air amount sensor for detecting said drawn air amount, said injector control apparatus includes expected drawn air amount correcting means for correcting said expected drawn air amount based on said drawn air amount, and said target fuel injection amount calculating means calculates said target fuel injection amount based on an expected drawn air amount corrected by said expected drawn air amount correcting means.

6. A fuel injection control apparatus for an internal combustion engine according to claim 5, wherein said expected drawn air amount correcting means outputs, as a corrected expected drawn air amount, a value obtained by adding a variation amount of said expected drawn air amount to said drawn air amount.

7. A fuel injection control apparatus for an internal combustion engine according to claim 5, wherein said expected drawn air amount correcting means outputs, as a corrected expected drawn air amount, a value obtained by multiplying said drawn air amount by a variation ratio of said expected drawn air amount.

8. A fuel injection control apparatus for an internal combustion engine according to claim 1, wherein said target throttle opening degree calculating means outputs said target throttle opening degree after a predetermined delay time is elapsed from a timing for detecting said accelerator pedal opening degree.

9. A fuel injection control apparatus for an internal combustion engine according to claim 8, wherein said delay time corresponds to a predetermined crank angle.

10. A fuel injection control apparatus for an internal combustion engine according to claim 8, wherein said delay time is set equal to or greater than a length corresponding to a time period from a fuel injection starting timing which is synchronous with said crank angle signal to an intermediate point of the next air-drawing process.

* * * * *